US005738561A

United States Patent [19]

Pracas

[11] Patent Number: 5,738,561

[45] Date of Patent: Apr. 14, 1998

[54] TALKING DOLL

[75] Inventor: Victor Manuel Pracas, Waroona, Australia

[73] Assignee: Concepts Development Australia Pty. Ltd., Perth, Australia

[21] Appl. No.: 619,743

[22] PCT Filed: Sep. 29, 1994

[86] PCT No.: PCT/AU94/00585

§ 371 Date: Jul. 18, 1996

§ 102(e) Date: Jul. 18, 1996

[87] PCT Pub. No.: WO95/09036

PCT Pub. Date: Apr. 6, 1995

[30] Foreign Application Priority Data

Sep. 30, 1993 [AU] Australia ..... PM1530

[51] Int. Cl.[6] ..... A63H 3/28

[52] U.S. Cl. ..... 446/297; 446/485; 446/390

[58] Field of Search ..... 446/297, 302, 446/303, 298–301, 484, 485, 390

[56] References Cited

U.S. PATENT DOCUMENTS

| | | | |
|---|---|---|---|
| 4,237,647 | 12/1980 | Shaw | 446/303 |
| 5,118,319 | 6/1992 | Smith et al. | 446/485 X |
| 5,279,514 | 1/1994 | Lacombe et al. | 446/297 |
| 5,376,038 | 12/1994 | Arad et al. | 446/302 X |

*Primary Examiner*—Mickey Yu
*Attorney, Agent, or Firm*—Michael Best & Friedrich LLP

[57] ABSTRACT

A doll having a microphone and sound recording device along with a sound playback device and a speaker. The doll is provided with contacts or buttons to activate the sound recording device and the sound playback device. A child may speak to the doll and record messages, which may be played back at a later time.

8 Claims, 7 Drawing Sheets

TALKING DOLL

FIELD OF THE INVENTION

The present invention relates to a doll.

BACKGROUND TO THE INVENTION

Dolls are commonly used as toys by children. Whilst children enjoy dolls as play items, dolls also perform an important function in the development of children's understanding of human relationships. In their play, children often treat dolls as though they were real, that is, children relate to dolls in the same way that they relate to people. Thus, dolls actually provide an important educational medium for a child's development of understanding human relationships.

This is further enhanced by the high degree of realism that is to be found in dolls appearance, clothing, movement, etc.

An important part of human behaviour which is learnt by a child is the development of trusting relationships with friends, family and other people. A significant aspect of such human relationships is the exchange and sharing of feelings and conversations in confidence. People tell things which are private or important to them only to certain friends or family.

A doll is thus a suitable medium to use in assisting children in learning about such human relationships in a realistic way and one which children will understand.

SUMMARY OF THE INVENTION

The present invention provides a doll which is able to digitally record sounds and later playback the recorded sounds. Typically, these sounds are messages which are spoken to the doll by a child and which can be later played back and listened to by the child.

According to the present invention there is provided a doll comprising:

- digital sound recording means for recording sounds in a first operational condition of the doll;
- sound playback means for playing back sounds recorded in said digital sound recording means in a second operational condition of the doll;
- first activation means actuable to activate said digital sound recording means in said first operational condition of the doll;
- second activation means actuable to activate said sound playback means in said second operational condition of the doll; and,
- a light provided on the doll in a location which is visible to the user, said light being operatively connected to said first activation means and adapted to illuminate when said first activation means is actuated to activate said digital sound recording means in said first operational condition of the doll.

DETAILED DESCRIPTION OF THE PREFERRED EMBODIMENTS

Figure 1:
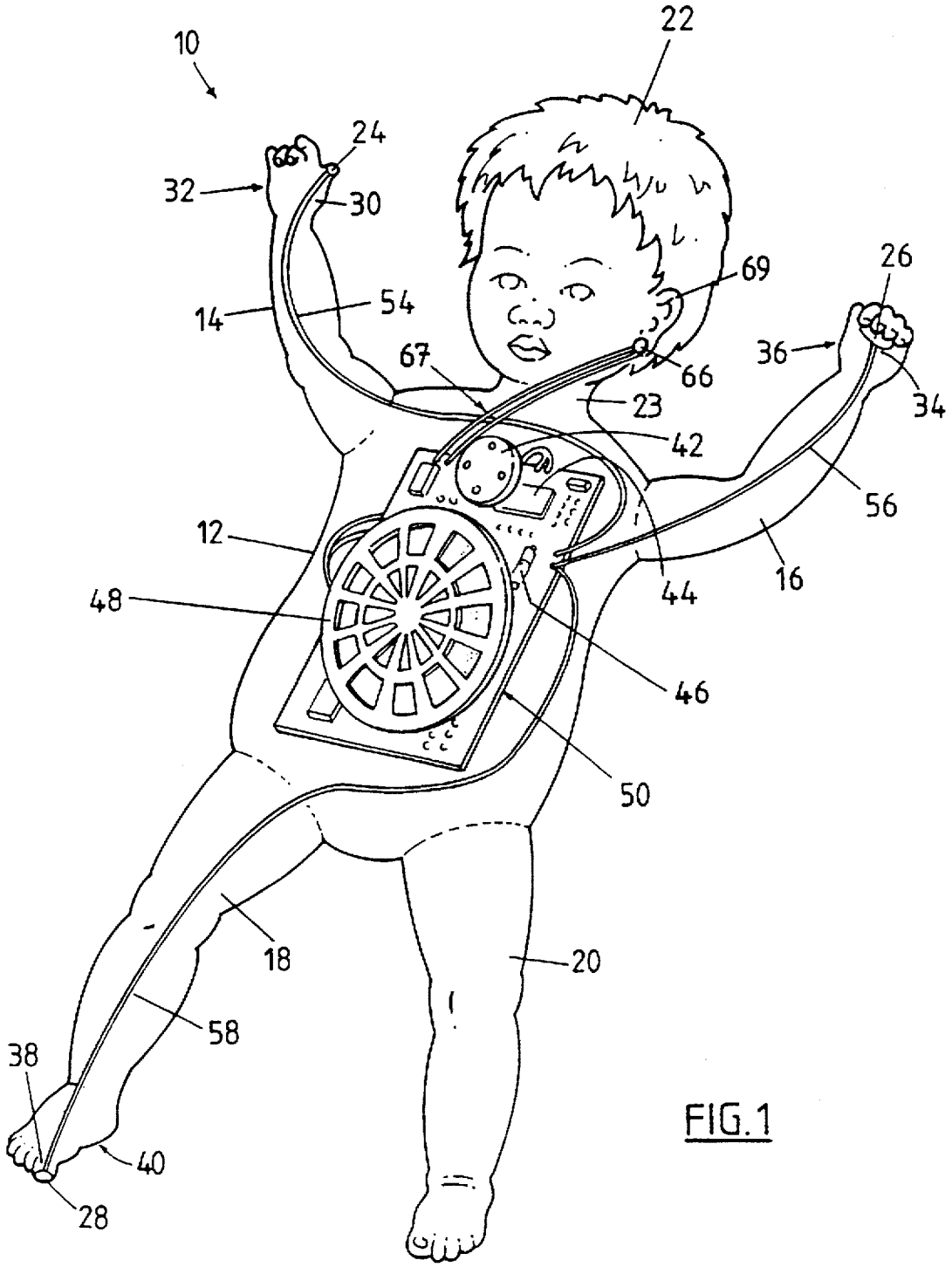
FIG. 1 is a perspective view of a first embodiment of a doll in accordance with the present invention partly showing the interior thereof.
Figure 3:
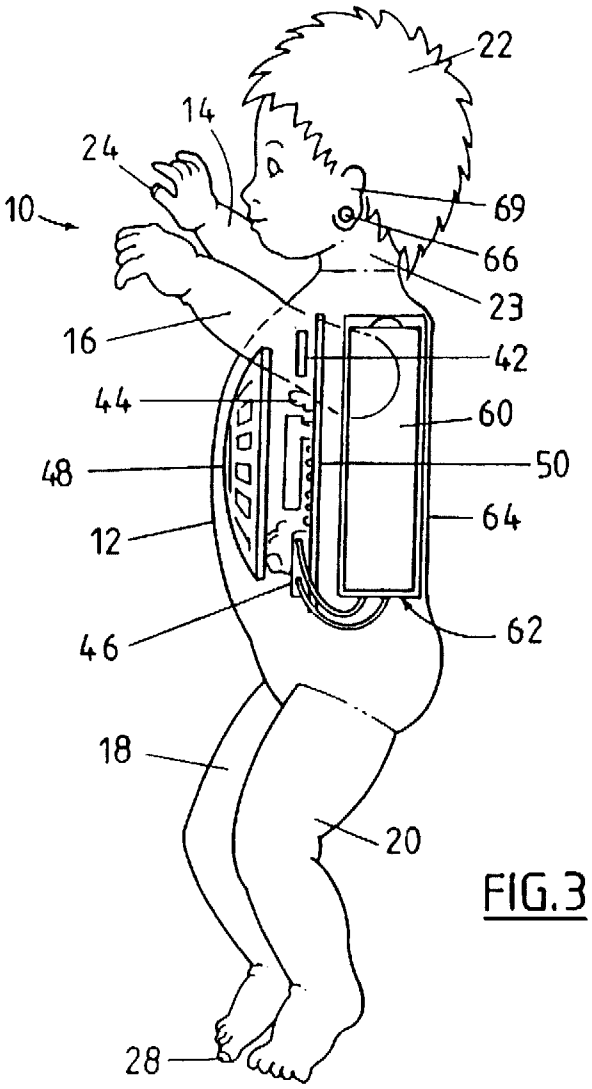
FIG. 3 is a side view of the doll shown in FIG. 1 partly showing the interior thereof.
Figure 2:
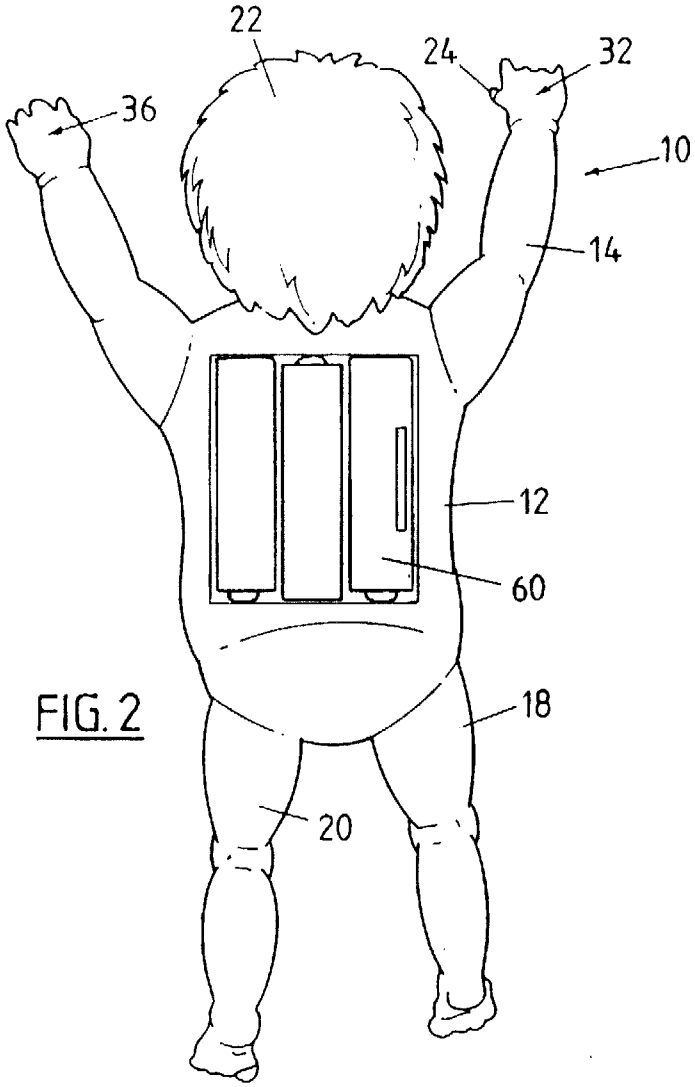
FIG. 2 is a rear view of the doll shown in FIG. 1 with the cover plate of the power source compartment removed.

In FIGS. 1 to 4F there is shown a doll 10 in accordance with a first embodiment of the present invention. The doll 10 comprises a torso 12 and limbs in the form of a pair of arms 14 and 16 and a pair of legs 18 and 20. The arms 14, 16 and at least the leg 18 are resiliently attached to the torso 12 so that they can move relative to the torso 12. The doll 10 is also provided with a head 22 attached to the torso 12 by a neck 23.

The arm 14 is provided with a contact 24. The arm 16 is provided with a contact 26. The leg 18 is provided with a contact 28. The contacts 24, 26 and 28 are provided at the outer surface of the doll 10.

Preferably, the contact 24 is provided in the thumb 30 of the hand 32 of the arm 14.

Preferably, the contact 26 is provided in the palm 34 of the hand 36 of the arm 16.

Preferably, the contact 28 is provided in the large toe 38 of the foot 40 of the leg 18.

The doll 10 is further provided with digital sound recording means and sound playback The digital sound recording means is activated by first activation means and the sound playback means is activated by second activation means.

Preferably, the digital sound recording means and sound playback means are provided in the torso 12.

The digital sound recording means comprises a microphone 42 connected to a digital recording device 44 to record sound.

The sound playback means comprises a device 46 to play sound previously recorded and a speaker 48.

The devices 44 and 46 permit the sound to be digitally recorded and played back.

The devices 44 and 46 may be provided on a circuit board 50.

The contact 24 is connected to the digital sound recording device 44 by a lead 54. The contact 26 is connected to the digital sound recording device 44 and the sound playback device 46 by a lead 56.

The first activation means comprises the contacts 24 and 26.

The contact 28 is connected to the sound playback device 46 by a lead 58.

The second activation means comprises the contacts 26 and 28.

A power source is provided for the doll 10.

The power source may be a battery pack 60 housed in a compartment 62 at the rear of the doll 10.

A cover plate 64 may be provided to cover the compartment 62.

A light 66 may be provided on the doll 10 and illuminates in a first operational condition of the doll 10, viz. in the record mode. The light 60 is connected to other components by leads 67.

The leads 54,56,58 and 67 are located inside the doll 10.

Preferably, the light 66 is provided on an ear 69 of the doll 10 to simulate an earring.

The manner of operation and use of the doll 10 of the first embodiment of the present invention will now be described with reference to the drawings.

In a non-operational condition of the doll 10, the arms 14,16 and the legs 18,20 are spaced apart, as shown in FIGS. 1–4A and 4D.

The arms 14 and 16 can be moved from their spaced apart condition toward one another to bring the contacts 24 and 26 into contact to actuate the first activation means. This is shown in FIGS. 4B and 4C. In this position, the thumb 30 of the hand 32 is received in the palm 34 of the hand 36. This activates the digital second recording means to place the doll 10 into its first operational condition.

In the first operational condition of the doll 10, the digital sound recording means is activated and sounds picked up by the microphone 42 are recorded by the digital sound recording device 44. Thus, a user (typically a child) may speak to the doll 10 and record messages.

Figure 4A:
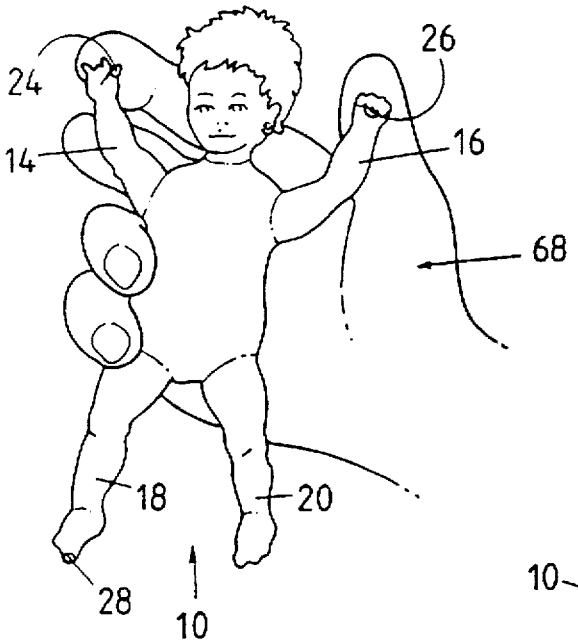
FIGS. 4A to 4F are sequential views showing the operation of the doll shown in FIG. 1.
Figure 4B:
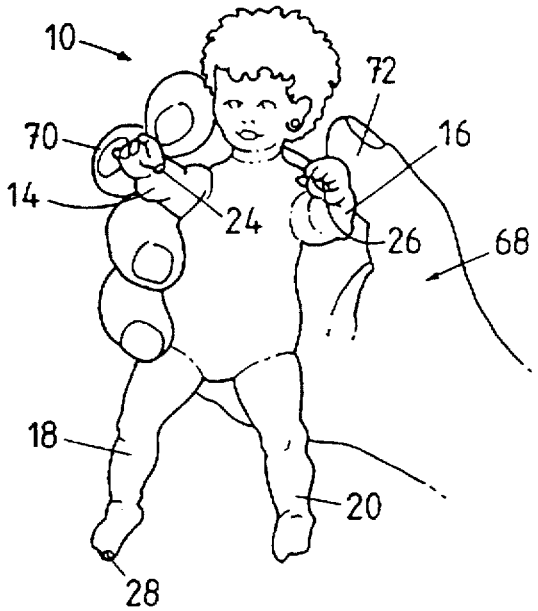
Figure 4C:
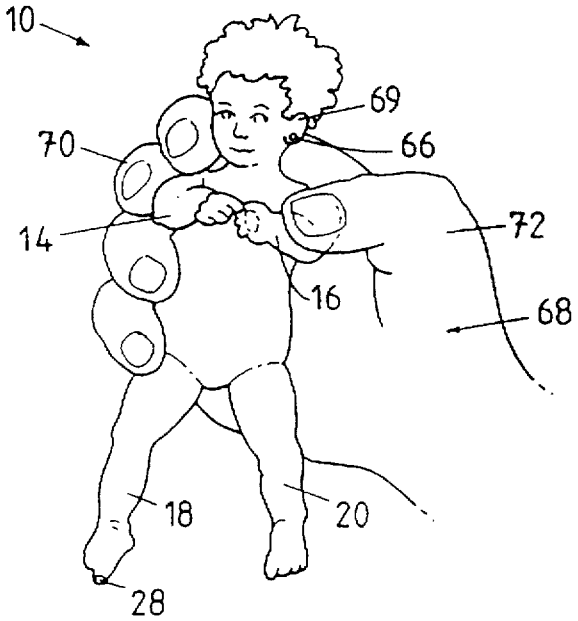
Figure 4D:
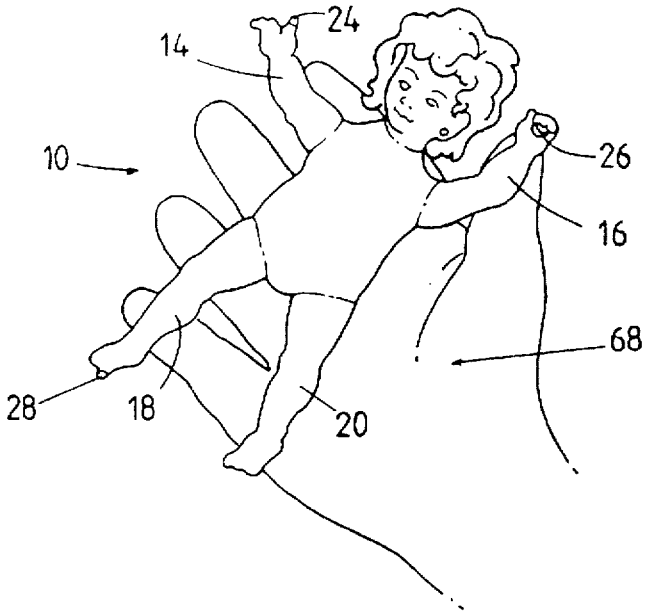

The arms 14 and 16 are arranged such that they can be moved together, as shown in FIG. 4C, and when released return to the position as shown in FIG. 4D (and FIG. 4A).

The digital recording device 44 is de-activated when the contact between the contacts 24 and 26 is broken. This occurs when the arms 14 and 16 are released. The arms 14 and 16 then return to their spaced apart condition, as shown in FIG. 4D.

Figure 4E:
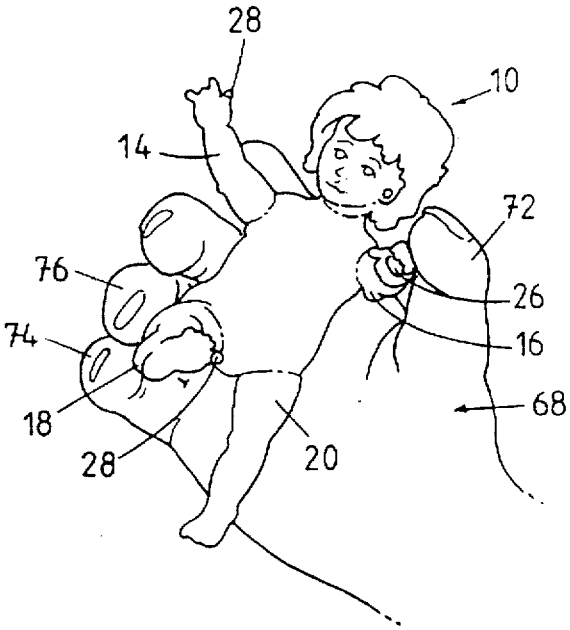
Figure 4F:
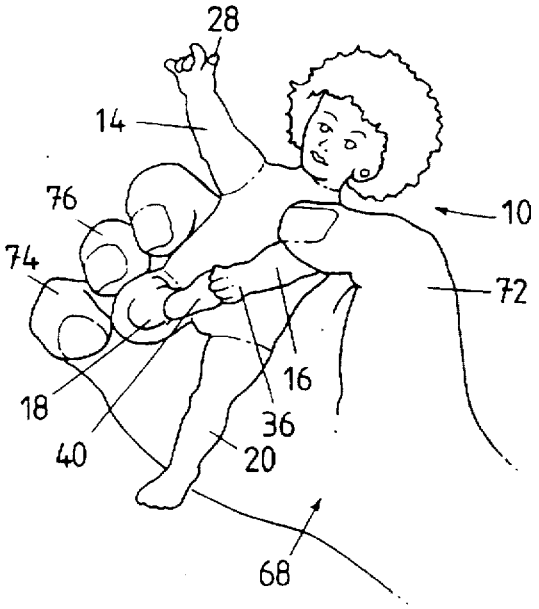
Figure 5:
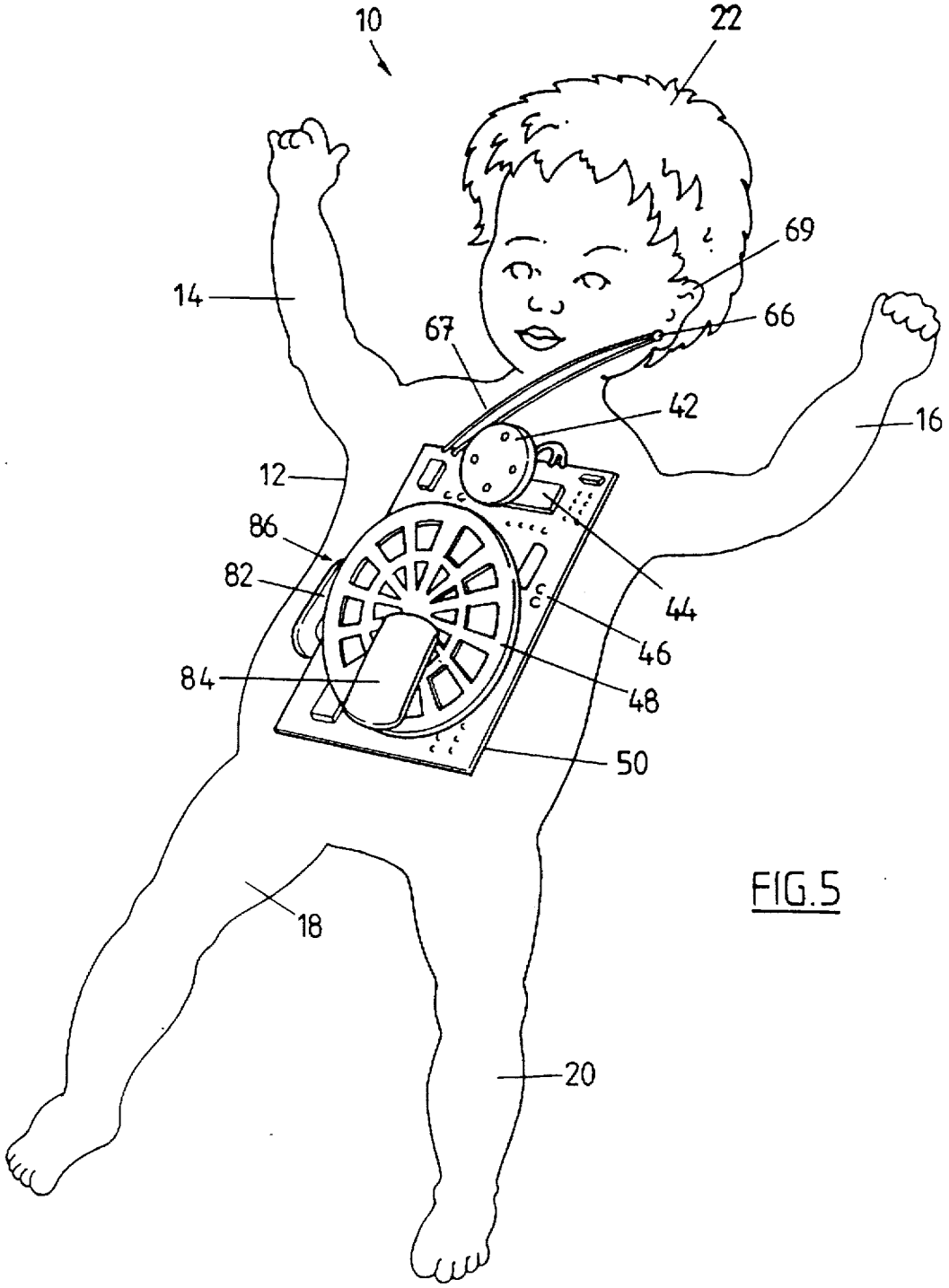
FIG. 5 is a perspective view of a second embodiment of a doll in accordance with the present invention partly showing the interior thereof.
Figure 6:
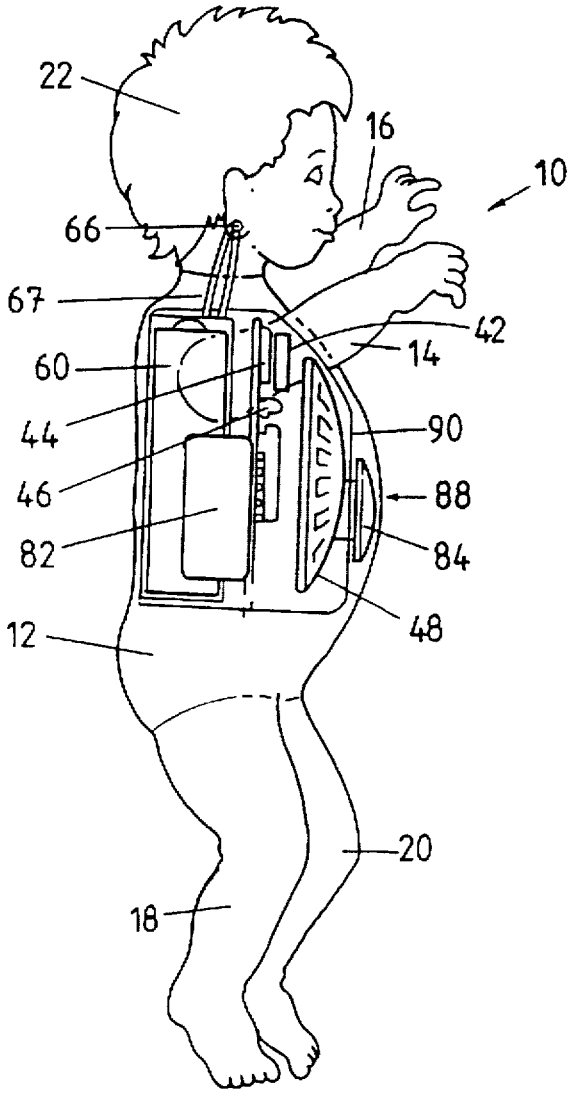
FIG. 6 is a side view of the doll shown in FIG. 5 partly showing the interior thereof.

The arm 16 and the leg 18 can be brought toward one another, from their spaced apart condition, to bring the contacts 26 and 28 into contact with one another to actuate the second activation means. This is shown in FIGS. 4E and 4F. In the position shown in FIG. 4F, the large toe 38 of the foot 40 is received in the palm 34 of the hand 36. This activates the sound playback means to place the doll 10 into its second operational condition.

In the second operational condition of the doll 10, the playback device 46 will playback the sound which was previously recorded by the digital recording device 44. The sound played back is then heard through the speaker 48. Thus, the child can listen to messages previously recorded.

When the contact between the contacts 26 and 28 is broken, the playback device 46 is de-activated and the doll 10 is returned to the non-operational condition. This occurs when the arms 14 and 16 are released. The arms 14 and 16 then return to their spaced apart condition, as shown in FIG. 4A.

The arms 14,16 and at least the leg 18 are resiliently attached to the torso 12 such that the arms 14 and 16, and the arm 16 and leg 18 can be brought together and return to their spaced apart condition when released.

The contacts 24 and 26, and the contacts 26 and 28 make contact so long as the arms 14 and 16, and the arm 16 and leg 18 are held together.

The torso 12 is comprised of resilient material.

The digital sound recording means may provide for more than one message to be recorded. The sound playback means may provide for a selected recorded message to be played back. The message desired for playback can then be selected by contacting the contacts 26 and 28, the corresponding number of times.

Thus, if it is desired to listen to the third message recorded by the digital sound recording means, then the contacts 26 and 28 are contacted three times in quick succession.

Preferably, the doll 10 is of a size which permits one handed operation by a child.

For example, the doll 10 may be approximately 10 cm in height.

Accordingly, the doll 10 may be used by the user cradling the doll 10 in his/her hand 68.

The user can then bring the arms 14 and 16 together using the middle finger 70 and throb 72 of his/her hand 68. This places the doll 10 into the first operational condition. This is shown in FIGS. 4B and 4C.

When the user releases the arms 14 and 16, they return to the spaced apart condition.

This is the non-operational condition of the doll 10. This is shown in FIG. 4D.

The user can then bring the arm 16 and leg 18 together using the short finger 74 (and ring finger 76 if needed) and thumb 72 of his/her hand 68. This places the doll 10 into the second operational condition. This is shown in FIGS. 4E and 4F.

When the user releases the arm 16 and leg 18, they return to the spaced apart condition, shown in FIG. 4D.

The doll 10 can be operated in this way using the right or left hand of the user.

The doll 10 of the present invention may be used by a child to record messages and later playback the recorded messages.

In FIGS. 5 to 7C, there is shown a doll 10 in accordance with a second embodiment of the present invention.

The doll 10 shown in FIGS. 5 to 7C is identical to the doll 10 shown in FIGS. 1 to 4F except that the leads 54,56 and 58 and the contacts 24,26 and 28 are replaced by press buttons 82 and 84. Thus, the same reference numbers are used in FIGS. 5 to 7C as were used in FIGS. 1 to 4F.

The first and second activation means comprise the press buttons 82 and 84, respectively.

The press button 82 (sound record) may be provided in the torso 12 at the side 86 of the doll 10.

The press button 84 (sound playback) may be provided in the torso 12 at the tummy or navel 88 of the doll 10.

The sound recording means (microphone 42 and sound recording device 44) and sound playback means (sound playback device 46 and speaker 48) along with the first and second activation means (press buttons 82 and 84) may be housed in a module 90 in the torso 12 of the doll 10 shown in FIGS. 5 to 7C, with the press buttons 82 and 84 protruding from the module 90. (Such a module 90 is also used in the doll 10 shown in FIGS. 1 to 4F, although it has not ben shown in the drawings.)

The manner of operation and use of the doll 10 shown in FIGS. 5 to 7C will now be described with reference to the drawings.

In a non-operational condition of the doll 10, the doll 10 is in neither a sound recording or sound playback condition.

The first activation means can be actuated to activate the digital sound recording means.

This is done by pressing the torso 12 at the side 86 of the doll 10. This depresses the press button 82 which activates the digital sound recording means, in the first operational condition of the doll 10, so that sounds picked up by the microphone 42 are recorded by the digital sound recording device 44. Thus, a user (typically a child) may speak to the doll 10 and record messages. When the pressure is removed from the torso 12 at the side 86 of the doll 10, the press button 82 is released and the first operational condition of the doll 10 ceases. This deactivates the digital recording device 44.

The doll 10 may be pressed at the rummy or navel 88 to depress the press button 84 in the second operational condition of the doll 10. In this second operational condition of the doll 10, the playback device 46 will play back the sound which was previously recorded by the digital recording device 44. The sound played back is then heard through the speaker 48. Thus, the child is able to listen to messages previously recorded. When pressure is removed from the tummy or navel region 88, the press button 84 is released and the playback device 46 is deactivated and the doll 10 returns to its non-operational condition.

The digital sound recording means may provide for more than one message to be recorded, and the sound playback means may provide for a selected recorded message to be played back. The message desired for playback can then be selected by depressing the tummy or navel region 88 of the doll 10 to depress the press button 84 the corresponding number of times. Thus, if it is desired to listen to the third message recorded by the digital sound recording means, then the tummy or navel region 88 is pressed to depress the press button 84 three times in quick succession.

The doll 10 may be of a size which permits one handed operation by a child.

In such a case, the doll 10 may be used by the child cradling the doll 10 in his/her hand 68.

Figure 7C:
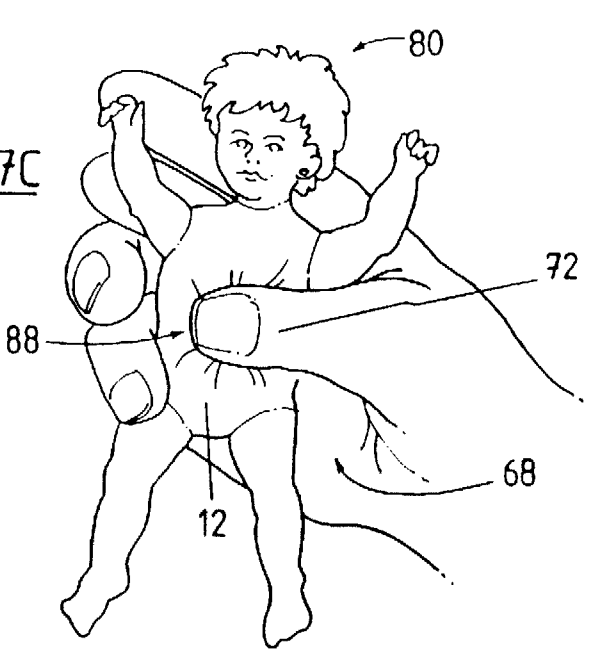
FIGS. 7A to 7C are sequential views showing the operation of the doll shown in FIG. 5.
Figure 7B:
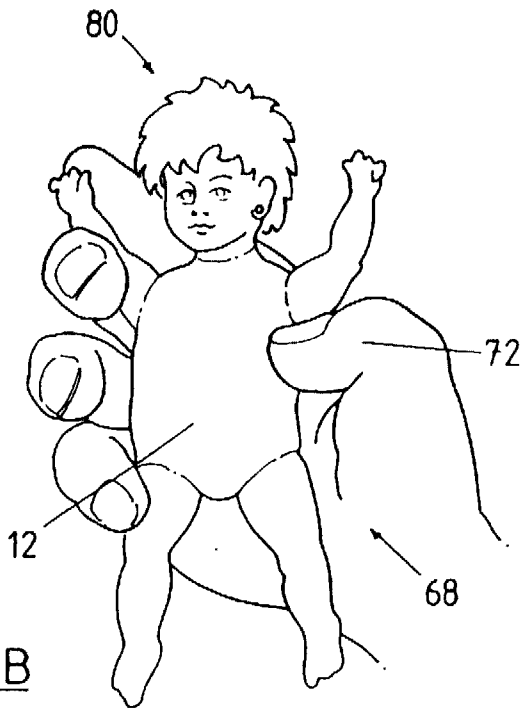
Figure 7A:
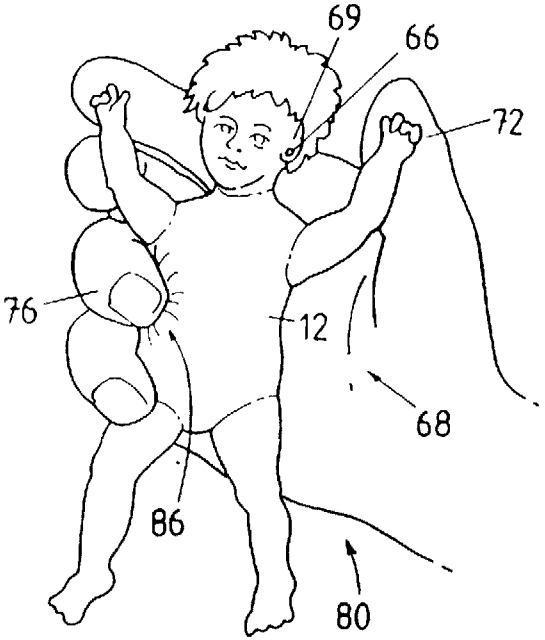

This is shown in FIGS. 7A–7C.

The child can then press the side 86 of the doll 10 with his/her ring finger 76 to activate the digital sound recording means. This places the doll 10 into the first operational condition and is shown in FIG. 7A.

When the child releases pressure from the side 86 of the doll 10, the doll 10 returns to its non-operational condition. This is shown in FIG. 7B.

The child may then press the tummy or navel region 88 with his/her thumb 72. This places the doll 10 into the second operational condition. This is shown in FIG. 7C.

When the child releases his/her thumb 72 from the rummy or navel region 88, the doll 10 returns to its non-operational condition as shown in FIG. 7B.

The first activation means of the doll 10 (shown in FIGS. 1 to 4F) may be used in place of (or in addition to) the first activation means of the doll 10 (shown in FIGS. 5 to 7C) and vice versa.

Similarly, the second activation means of the doll 10 (shown in FIGS. 1 to 4F) may be used in place of (or in addition to) the second activation means of the doll 10 (shown in FIGS. 5 to 7C) and vice versa.

The present invention enables a child to speak to the doll 10. Messages spoken to the doll 10, can be digitally recorded. The child is then able to listen to the doll 10, speak the messages previously spoken to (and recorded by) the doll 10.

Modifications and variation such as would be apparent to a skilled addressee are deemed within the scope of the present invention.

The claims defining the invention are as follows:

1. A doll comprising:

a digital sound recording means for recording sounds in a first operational condition of the doll;

sound playback means for playing back sounds recorded in said digital sound recording means in a second operational condition of the doll;

first activation means actuable to activate said digital sound recording means in said first operational condition of the doll;

second activation means actuable to active said sound playback means in said second operational condition of the doll;

a light provided on the doll in a location which is visible to the user, said light being operatively connected to said first activation means and adapted to illuminate when said first activation means is actuated to activate said digital sound recording means in said first operational condition of the doll; and, a torso with a head attached to said torso and wherein said light is located on the head of the doll, and further wherein said light is provided on an ear of the doll's head so as to give the appearance of an earring or ear stud, and wherein said doll is provided with limbs attached to said torso and said first activation means comprises a first contact and a second contact provided on a first limb and a second limb respectively of said doll, said first and second limbs being resiliently attached to said torso to permit said first and second limbs to move toward one another so as to bring said first and second contacts into contact whereby, in use, the doll can be switched from a non-operational condition to said first operational condition, and wherein said second activation means comprises said second contact and a third contact provided on a third limb of said doll, said third limb being resiliently attached to said torso to permit said second and third limbs to move toward one another so as to bring said second and third contact into contact whereby, in use, the doll can be switched from a non-operational condition to said second operational condition.

2. A doll according to claim 1, wherein said first and second limbs are the arms of said doll.

3. A doll according to claim 2, wherein said first contact is provided at a finger of one hand of said doll and said second contact is provided at the palm of the other hand of said doll.

4. A doll according to claim 1, wherein said second and third limbs are an arm and a leg, respectively, of said doll.

5. A doll according to claim 4, wherein said second contact is provided at the palm of a hand of said doll and said third contact is provided at a foot of said doll.

6. A doll according to claim 1, wherein said digital sound recording means comprises a microphone and a digital sound recording device.

7. A doll according to claim 1, wherein said sound playback means comprises a sound playback device and a loudspeaker.

8. A doll according to claim 1, wherein said torso is adapted to fit in the palm of a child's hand and said first and second activation means are actuable using the fingers and/or thumb of the same hand.

* * * * *

UNITED STATES PATENT AND TRADEMARK OFFICE

CERTIFICATE OF CORRECTION

PATENT NO. : 5,738,561

DATED : April 14, 1998

INVENTOR(S) : Victor Manuel Pracas

It is certified that error appears in the above-indentified patent and that said Letters Patent is hereby corrected as shown below:

Column 2, line 32, "means and sound playback" should be -- "means and sound playback means. --

Column 4, line 8, "throb" should be -- thumb --

Column 5, line 1, "rummy" should be -- tummy --

Column 5, line 38, "rummy" should be -- tummy --

Column 5, line 55, "variation" should be -- variations --

Column 6, line 53, "sound playback means" should be -- second playback means --

Signed and Sealed this

Eighteenth Day of August, 1998

Bruce Lehman

*Attest:*

BRUCE LEHMAN

*Attesting Officer*

*Commissioner of Patents and Trademarks*